US010041149B2

(12) United States Patent
Gaag et al.

(10) Patent No.: US 10,041,149 B2
(45) Date of Patent: Aug. 7, 2018

(54) NICKEL-FREE WHITE CUZN ALLOY AND FITTING USING THE ALLOY

(71) Applicant: DIEHL METALL STIFTUNG & CO. KG, Roethenbach (DE)

(72) Inventors: Norbert Gaag, Lauf (DE); Florian Seuss, Buckenhof (DE)

(73) Assignee: Diehl Metall Stiftung & Co. KG, Roethenbach (DE)

( * ) Notice: Subject to any disclaimer, the term of this patent is extended or adjusted under 35 U.S.C. 154(b) by 126 days.

(21) Appl. No.: 15/285,693

(22) Filed: Oct. 5, 2016

(65) Prior Publication Data

US 2017/0101701 A1 Apr. 13, 2017

(30) Foreign Application Priority Data

Oct. 9, 2015 (DE) ..... 10 2015 013 201

(51) Int. Cl.
*C22C 9/04* (2006.01)
*C22C 9/05* (2006.01)

(52) U.S. Cl.
CPC ..... *C22C 9/05* (2013.01)

(58) Field of Classification Search
CPC ..... C22C 9/04; C22C 9/05
USPC ..... 420/480; 148/434
See application file for complete search history.

(56) References Cited

U.S. PATENT DOCUMENTS 3,778,237 A * 12/1973 Shapiro ..... C22C 9/04 428/673
5,582,281 A 12/1996 Nakashima et al.
6,340,446 B1 1/2002 Kita et al.
8,435,361 B2 * 5/2013 Gaag ..... C22C 9/04 420/480
9,301,515 B2 * 4/2016 Gaag ..... C22C 9/04
2003/0110601 A1 6/2003 Sugimoto et al.
2007/0062619 A1 3/2007 Maehara et al.
2008/0283353 A1 * 11/2008 Holderied ..... C22C 9/04 420/480
2010/0061884 A1 * 3/2010 Clark ..... C22C 9/04 420/480

FOREIGN PATENT DOCUMENTS

DE 1194153 B 6/1965
DE 4313308 C1 4/1994
DE 4325217 A1 2/1995
DE 10016525 A1 10/2000
EP 1045042 A1 10/2000
EP 1319728 A1 6/2003
EP 1731624 A1 12/2006
JP S54132424 A 10/1979

OTHER PUBLICATIONS

EPO Search Report for EP 16002090, dated Mar. 2, 2017; 2 pages.*

* cited by examiner

*Primary Examiner* — Helene Klemanski
(74) *Attorney, Agent, or Firm* — Laurence A. Greenberg; Werner H. Stemer; Ralph E. Locher

(57) ABSTRACT

A nickel-free white CuZn alloy. The alloy includes the following alloying elements:
from 63.0 to 67.0% of Cu,
from 0.01 to 0.15% of Pb,
from 0.01 to 0.2% of Fe,
from 1.3 to 2.5% of Al,
from 12.0 to 15.0% of Mn,
a balance of Zn, and
unavoidable impurities.

12 Claims, 1 Drawing Sheet

| Deformation | Comparative alloy | Alloy |
|---|---|---|
| 50 %<br>Max. deformation |  |  |
| Max. possible deformation | 53.5% | 71.5% |

| Deformation | Comparative alloy | Alloy |
|---|---|---|
| 50 %<br>60 %<br>70 %<br>Max. deformation |  |  |
| Max. possible deformation | 72 %<br>Cracks above 60% | 74. 5%<br>No cracks |

NICKEL-FREE WHITE CUZN ALLOY AND FITTING USING THE ALLOY

CROSS-REFERENCE TO RELATED APPLICATION

This application claims the priority, under 35 U.S.C. § 119, of German Patent Application DE 10 2015 013 201.6, filed Oct. 9, 2015; the prior application is herewith incorporated by reference in its entirety.

BACKGROUND OF THE INVENTION

Field of the Invention

The invention relates to a nickel-free white CuZn alloy as well as a fitting using such a nickel-free white CuZn alloy.

Nickel-free white CuZn alloys are distinguished by their white color and also their antiallergic properties. They are therefore used, in particular, for producing zip fasteners, metal buttons and the like. On that subject, reference is made by way of example to European Patent Application EP 1 319 728 A1, corresponding to U.S. Patent Application US 2003/0110601. The nickel-free white CuZn alloy known therefrom is formed of the elements Cu, Zn and Mn.

German Patent Application DE 100 16 525 A1 and the corresponding European Patent Application EP 1 045 042 A1, corresponding to U.S. Pat. No. 6,340,446, disclose a nickel-free white CuZn alloy which contains from 0.5 to 4% of Al in order to improve the stress cracking resistance. In addition, alloying elements from the group including Si, Ti and Cr can be present.

German Patent DE 43 25 217 C2 discloses a further nickel-free white CuZn alloy for producing zip fasteners. Adding a content of 2% of Al to the alloy in order to improve the stress cracking resistance is known therefrom.

The known nickel-free white CuZn alloys do not have particularly good extrusion properties. There is accordingly a need to provide a nickel-free white CuZn alloy having improved extrusion properties.

SUMMARY OF THE INVENTION

It is accordingly an object of the invention to provide a nickel-free white CuZn alloy and a fitting using the alloy, which overcome the hereinafore-mentioned disadvantages of the heretofore-known alloys and fittings of this general type and which satisfy the need mentioned above.

With the foregoing and other objects in view there is provided, in accordance with the invention, a nickel-free white CuZn alloy (hereinafter: alloy), comprising the following alloying elements:

from 63.0 to 67.0% of Cu,
from 0.01 to 0.15% of Pb,
from 0.01 to 0.2% of Fe,
from 1.3 to 2.5% of Al,
from 12.0 to 15.0% of Mn,
a balance of Zn, and
unavoidable impurities.

The proposed alloy displays improved extrusion properties. It is white and has, in particular, good antimicrobial properties. It is therefore particularly suitable for producing fittings in buildings in the health care sector, e.g. hospitals, nursing homes or doctors' offices, and also in all public buildings having high public traffic. The proposed alloy can, for example, be used for producing fittings for doors, windows, e.g. door and window handles, door plates, and for producing handrails.

In accordance with another feature of the invention, the alloy can contain from 0 to 0.2% of Sn.

In an advantageous embodiment, from 63.5 to 66.0%, preferably from 64.0 to 65.5%, of Cu is present in the alloy.

In a further embodiment, the alloy contains from 0.03 to 0.1%, preferably from 0.05 to 0.08%, of Pb. It can additionally contain from 1.5 to 2.3%, preferably from 1.9 to 2.1%, of Al. Furthermore, from 12.8 to 14.7%, preferably from 13.0 to 14.4%, of Mn can be present.

The alloy advantageously is formed of the above-mentioned alloying elements.

With the objects of the invention in view, there is concomitantly provided a fitting for doors, windows or furniture or for producing handrails, the fitting comprising a nickel-free white CuZn alloy according to the invention.

For the purposes of the invention, "%" means "% by weight."

An example is an alloy including the following alloying elements:

64.7% of Cu,
0.06% of Pb,
0.08% of Fe,
0.05% of Sn,
2.0% of Al,
13.2% of Mn,
a balance of Zn, and
unavoidable impurities.

Other features which are considered as characteristic for the invention are set forth in the appended claims.

Although the invention is illustrated and described herein as embodied in a nickel-free white CuZn alloy and a fitting using the alloy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
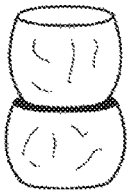
FIG. 1 is a table showing the result of compression tests at 600° C.
Figure 1:
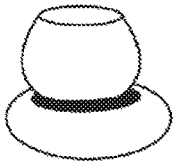
Figure 2:
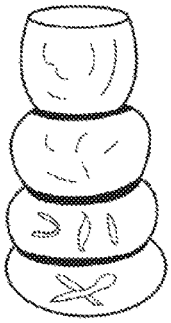
FIG. 2 is a table showing the result of compression tests at 700° C.
Figure 2:
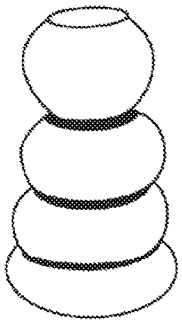

Referring now in detail to FIGS. 1 and 2 of the drawings, which make the improved extrusion properties of the alloy of the invention clear, it is seen that the specimens used for carrying out the compression tests shown in the figures had the following dimensions:

Specimen diameter: 10 mm

Specimen height: 20 mm

The comparative alloy had the following composition:

Cu: 65.6%
Al: 0.98%
Mn: 14.5%
Zn: Balance

The alloy according to the invention had the following composition:

Cu: 64.7%
Al: 2.0%
Mn: 13.2%
Pb: 0.06%
Fe: 0.08%
Zn: Balance

FIG. 1 shows the result of compression tests at 600° C. The alloy according to the invention can be deformed significantly better. A "maximum possible deformation" obtained when exerting the maximum force of the press used for carrying out the compression tests is 53.5% in the case of the comparative alloy and 71.5% in the case of the alloy according to the invention.

FIG. 2 shows the result of compression tests at 700° C. The comparative alloy displays significant crack formation above a deformation of 60%. The alloy according to the invention, on the other hand, can be deformed without cracks up to a maximum deformation of 74.5%.

As can be seen from FIGS. 1 and 2, the alloy according to the invention displays improved deformation properties and thus also improved extrusion properties.

The advantageous properties of the alloy compared to corresponding alloys according to the prior art are attributed, in particular, to the alloy containing from 0.01 to 0.15% of Pb and from 0.01 to 0.2% of Fe.

The invention claimed is:

1. A nickel-free white CuZn alloy, comprising the following alloying elements:

from 63.0 to 67.0% of Cu,
from 0.01 to 0.15% of Pb,
from 0.01 to 0.2% of Fe,
from 1.3 to 2.5% of Al,
from 12.0 to 15.0% of Mn,
a balance of Zn, and
unavoidable impurities.

2. The nickel-free white CuZn alloy according to claim 1, which further comprises from 0 to 0.2% of Sn.

3. The nickel-free white CuZn alloy according to claim 1, wherein said Cu alloying element has a content of from 63.5 to 66.0%.

4. The nickel-free white CuZn alloy according to claim 1, wherein said Cu alloying element has a content of from 64.0 to 65.5%.

5. The nickel-free white CuZn alloy according to claim 1, wherein said Pb alloying element has a content of from 0.03 to 0.1%.

6. The nickel-free white CuZn alloy according to claim 1, wherein said Pb alloying element has a content of from 0.05 to 0.08%.

7. The nickel-free white CuZn alloy according to claim 1, wherein said Al alloying element has a content of from 1.5 to 2.3%.

8. The nickel-free white CuZn alloy according to claim 1, wherein said Al alloying element has a content of from 1.9 to 2.1%.

9. The nickel-free white CuZn alloy according to claim 1, wherein said Mn alloying element has a content of from 12.8 to 14.7%.

10. The nickel-free white CuZn alloy according to claim 1, wherein said Mn alloying element has a content of from 13.0 to 14.4%.

11. The nickel-free white CuZn alloy according to claim 2, wherein the alloy is formed of said alloying elements.

12. A fitting for doors, windows or furniture or for producing handrails, the fitting comprising:

a nickel-free white CuZn alloy according to claim 1.

* * * * *